United States Patent [19]

Gibas

[11] Patent Number: 4,677,410

[45] Date of Patent: Jun. 30, 1987

[54] ARMATURE BEARING RING FOR AN ELECTROMAGNET

[75] Inventor: Christoph Gibas, Neunkirchnen, Fed. Rep. of Germany

[73] Assignee: BSO Steurungstechnik GmbH, Sulzbach/Saar, Fed. Rep. of Germany

[21] Appl. No.: 889,620

[22] Filed: Jul. 28, 1986

[30] Foreign Application Priority Data

Jul. 31, 1985 [DE] Fed. Rep. of Germany ..... 3527423

[51] Int. Cl.[4] ..... H01F 7/08

[52] U.S. Cl. ..... 335/262; 335/279

[58] Field of Search ..... 335/251, 255, 257, 261, 335/262, 279

[56] References Cited

U.S. PATENT DOCUMENTS

| | | | |
|---|---|---|---|
| 3,510,814 | 5/1970 | Nordfors | 335/262 |
| 4,004,343 | 1/1977 | Marsden | 335/262 X |
| 4,131,866 | 12/1978 | Torr | 335/262 |
| 4,525,695 | 6/1985 | Sheng et al. | 335/262 |

FOREIGN PATENT DOCUMENTS

| | | | |
|---|---|---|---|
| 1850887 | 5/1962 | Fed. Rep. of Germany | 335/262 |

*Primary Examiner*—George Harris

*Attorney, Agent, or Firm*—Roylance, Abrams, Berdo & Goodman

[57] ABSTRACT

An electromagnet or solenoid includes an armature in the form of a piston guided for sliding axially in a magnet housing surrounding it. The armature has at least one bearing ring providing the slide bearing of the piston. The bearing ring is held by engagement in at least one groove in the outer surface of the piston. The groove extends axially on the piston and is open to one piston end surface so that the bearing ring and the groove are engaged without great deformation of the bearing ring and the bearing ring can be closed. The bearing ring has an inwardly projecting curvature engaging the groove. The outside edges of the groove are rounded along a length corresponding to the width of the bearing ring forming an edge recess which receives the curvature and holds the bearing ring against axial thrust.

7 Claims, 3 Drawing Figures

Fig. 2
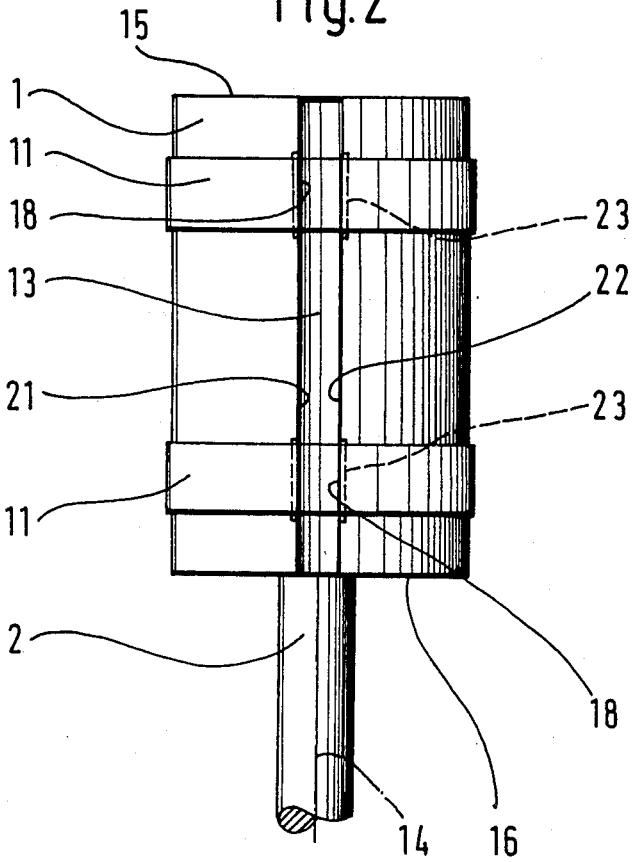
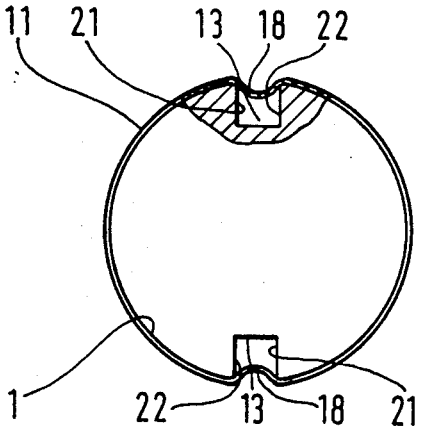
Fig. 3

ARMATURE BEARING RING FOR AN ELECTROMAGNET

FIELD OF THE INVENTION

The present invention relates to an electromagnet or solenoid, which is designated hereinafter throughout the specification and the claims to simplify matters as electromagnet, and wherein the armature is configured as a piston guided to slide axially within a tubular housing. The housing is surrounded on at least a part of its length by a coil of the magnet. To support its sliding within the tube, the armature carries at least one annular bearing ring of an elastic, nonmagnetic material, which bearing ring surrounds the armature and cooperates with a groove in the outside of the armature prohibiting movement relative to the groove. At least one radially inwardly projecting curvature on the bearing ring forms a configurational irregularity to mate with the groove. The bearing ring has a slippery material at least on its outside surface cooperating with the inside walls of the tubular housing.

BACKGROUND OF THE INVENTION

An electromagnet with a movable armature is disclosed in German Utility Patent No. 1,850,887. The bearing ring is configured of one part and is slotted so that the bearing ring can be spread apart or bent for the assembly process. The spreading apart or bending of the ring is indispensable. There is no other possible way of fitting the bearing ring into the respective annular groove of the piston armature when the bearing ring has dimensions that hold it against axial movement on the piston armature by engagement with the annular groove.

With conventional magnets, a costly material with high elasticity properties must be provided for the bearing ring. Additionally, danger exists that an outside coating of a slippery material on the bearing ring can be torn during assembly or can be flattened out when the ring is spread apart or bent.

SUMMARY OF THE INVENTION

An object of the invention is to provide an electromagnet in which an uninterrupted or continuous bearing ring can be mounted in position on a piston armature without deformation.

Another object of the present invention is to provide an electromagnet with a bearing ring which can be easily, safely and securely mounted about its armature.

The foregoing objects are attained according to the present invention with an electromagnet having a piston armature with a groove starting from one end surface of the armature and extending axially over at least a part of the axial length of the armature measured along the longitudinal axis of its tubular housing and transverse to the central plane of the bearing ring. The bearing ring is closed so that its curvature shape includes an uninterrupted rib extending axially along the groove. The width of the rib corresponds to that of the groove. The configurational irregularity cooperating with the curvature of the bearing ring includes rounded outside edges on facing axial walls of the groove along a length adapted to the width of the bearing ring. The rounded outside edges form a recess in which the bearing ring is held against the axial thrust of the armature.

As opposed to conventional annular grooves, the groove of the present invention is open toward the end surface of the piston armature. Thus, the part of the bearing ring provided for engagement in the groove can be introduced from the end surface of the piston into the groove, without requiring raising the bearing ring annular part over unrecessed areas on the piston armature surface, as is required with insertion of a slotted ring in an annular groove of a conventional piston armature.

With the configuration according to the present invention, the part of the bearing ring engaging in the groove is in the form of an inwardly projecting curvature. The curvature engages an edge recess provided on the groove, which edge recess is formed by rounding of the edges of the facing axial walls defining the groove. It is possible to configure the bearing ring as a closed ring which is not slotted. During the assembly process, the closed ring is widened by slight pulling out of the inward curvature only so far to permit the bearing ring to be thrust axially over the outer surface of the piston armature until the edges of the curvature are aligned with the edge recess of the groove. The elasticity of the bearing ring provides a click-catch to form a tight hold against axial thrusts on the bearing ring.

In the present invention, the closed bearing ring is deformed so slightly during the assembly operation that a slippery coating on the outside of the bearing ring is not in danger of being damaged. Since the deformation occurs only at the inward curvature, which curvature is pulled out somewhat with the widening of the bearing ring, any damage to the coating on the inward curvature presents no danger of disturbing the operation at the deformed points. These damaged points would lie within the area of the edge recess of the groove. In comparison with the outside of the bearing ring, the damaged points would be spaced radially inwardly, and thus, would not cooperate as a supporting sliding surface with the inside wall of the tubular housing.

In one advantageous exemplary embodiment, the groove extends axially along the piston armature in a straight line passing from the one end surface of the piston to the other end surface and has a plurality of edge recesses for holding identically configured, axially spaced bearing rings.

With another advantageous exemplary embodiment, the piston armature has two diametrically opposite, axial grooves, and each bearing ring is provided with two diametrically opposite, inwardly projecting curvatures.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure:

FIG. 2 is an enlarged, partial side elevational view of the piston armature of FIG. 1; and FIG. 3 is a top plan view partially in section of the piston armature of FIG. 2.

DETAILED DESCRIPTION OF PREFERRED EMBODIMENT

Figure 1:
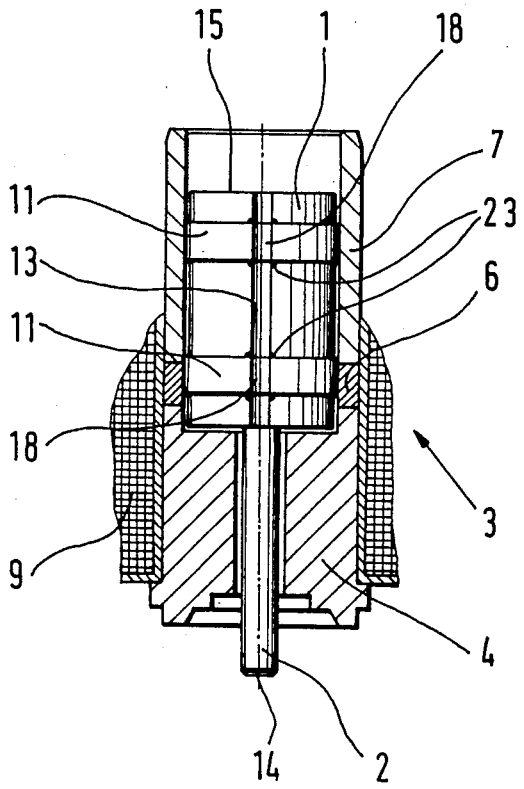
FIG. 1 is a partial side elevational view in section of an electromagnet according to the present invention.

The electromagnet of the present invention has a movable armature 1 in the shape of a piston connected with a push rod 2 concentric with the armature. Piston armature 1 is mounted for axial movement in a multiple-part magnet housing 3. Magnet housing 3 has an end part 4, an intermediate tube 6 attached axially thereto, and a magnet tube 7 mounted around the piston armature. End part 4, intermediate tube 6 and magnet tube 7 have inside walls forming a cylindrical surface surrounding piston armature 1 guided to slide axially in the other members. A magnet coil 9, partially shown in FIG. 1, surrounds the large part of end part 4, intermediate tube 6 and magnet tube 7 along part of its length.

The slide bearing of piston armature 1 has two identicly configured bearing rings 11. The bearing rings are formed on nonmagnetic material, for example, a strip of V2A steel, a brass alloy, a copper alloy or the like. To fix the position of bearing rings 11 on piston armature 1, the piston armature has two identically configured grooves 13, diametrically opposite each other. Each groove is cut out in the piston armature outer surface and extends, in the exemplary embodiment, in the direction of the piston longitudinal axis 14 in a straight line from the armature front end surface 15 through to the other end surface 16.

Each bearing ring 11 is a unitary, one piece closed ring with two diametrically opposite curvatures 18. The curvature configurations are identical to each other and form radially inwardly projecting ribs. The longitudinal axes of the ribs extend axially in grooves 13.

On the opposite or facing side walls 21 and 22 defining groove 13, edge recesses 23 are formed by impressed roundings of the free outer edges of side walls 21 and 22, i.e., the edges of side walls 21 and 22 on the outer surface of piston armature 1. Each edge recess has an axial length adapted to or corresponding to the width of bearing rings 11, and forms a seat in receiving the respective bearing ring by the associated inside surface of the respective curvature 18. The peripheral length of bearing rings 11 is selected such that curvatures 18 engage with preformed bias in edge recesses 23 on grooves 13 to axially hold bearing rings 11.

Upon mounting of bearing rings 11 on piston armature 1, a certain widening of bearing ring 11 is required by slightly widening curvatures 18 only. The widening of curvatures 18 is again diminished as soon as each bearing ring 11 is aligned with the respective edge recesses 23 on grooves 13. The widening of bearing rings 11 in the assembly process, only occurs by slight deformation of curvatures 18, i.e., in sections in which the outside surface of bearing ring 11, because of the presence of grooves 13 and edge recesses 23, lies radially inside the other peripheral areas of bearing rings 11. Any damage caused by the slight deformation of bearing rings 11, would be found on a nonsupporting point of the periphery of the bearing ring 11 so that the operational behavior is not adversely affected.

Bearing rings 11 preferably have a layer of a nonmagnetic, slippery material on their outside surfaces. This material has as low as possible permeability, e.g., a polymer containing fluorine of about 0.1 mm to 0.2 mm thickness. Thus, the outside diameter of piston armature 1 is selected with reference to the thickness of bearing rings 11 so that suitable play is present for the slide bearing of piston armature 1 between the inside wall of the cylinder and the outside of bearing rings 11 or their slippery coating.

While a particular embodiment has been chosen to illustrate the invention, it will be understood by those skilled in the art that various changes and modifications can be made therein without departing from the scope of the invention as defined in the appended claims.

What is claimed is:

1. An electromagnet, comprising;

a tube surrounded along at least part of a length thereof by a coil;

a piston-shaped armature slidably mounted in said tube for movement along longitudinal axes of said tube and said armature, said armature having opposite axial ends;

a first groove extending radially inwardly from an outer surface of said armature and extending axially along said armature from at least one of said axial ends; said first groove being defined by two facing axially extending walls, said walls having rounded free edge portions forming an edge recess extending axially for a first axial distance; and a generally annular closed bearing ring of elastic, non-magnetic material surrounding said armature and having an outer surface coated with slippery material, said outer surface cooperating with an inner surface of said tube, said bearing ring including an irregularity providing a first curved portion forming an uninterrupted axially extending, radially inwardly projecting rib extending along and with said first groove, said rib having a width to mate with said first groove, said bearing ring having an axial length substantially equal to said first axial distance such that engagement of said bearing ring in said edge recess holds said bearing ring in position against axial forces.

2. An electromagnet according to claim 1 wherein said first groove extends in a straight line to the other of said axial ends of said armature, and comprises a plurality of edge recesses retaining a plurality of identical, axially spaced bearing rings.

3. An electromagnet according to claim 2 wherein said armature comprises a second groove extending axially in the outer surface similar to and diametrically opposite said first groove; each said bearing ring comprises a second curved portion similar to and diametrically opposite said first curved portion, each said second curved portion projecting inwardly into said second groove, said second groove having rounded free edge portions forming another edge recess engaging and axially retaining said bearing rings.

4. An electromagnet according to claim 1 wherein said armature comprises a second groove extending axially in the outer surface similar to and diametrically opposite said first groove; said bearing ring comprises a second curved portion similar to and diametrically opposite said first curved portion, said second curved portion projecting inwardly into said second groove, said second groove having rounded free edge portions forming another edge recess engaging and axially retaining said bearing ring.

5. An electromagnet according to claim 1 wherein said first groove and said first curved portion have widths, said edge recess has a depth, and said bearing ring has a circumference such that said first curved portion is biased against said rounded edge portions.

6. An electromagnet according to claim 2 wherein said first groove and each said first curved portion have widths, said edge recesses have depths, and said bearing rings have circumferences such that each said first curved portion is biased against said rounded edge portions.

7. An electromagnet according to claim 4 wherein said grooves and said curved portions have widths, said edge recesses have depths, and said bearing ring has a circumference such that said curved portions are biased against said rounded edge portions.

* * * * *